US008083200B2

(12) United States Patent
Opresnik

(10) Patent No.: US 8,083,200 B2
(45) Date of Patent: Dec. 27, 2011

(54) BOOK REST WITH PAGE HOLDER

(76) Inventor: Cindy Jane Opresnik, Melbourne (AU)

( * ) Notice: Subject to any disclaimer, the term of this patent is extended or adjusted under 35 U.S.C. 154(b) by 0 days.

(21) Appl. No.: 12/799,738

(22) Filed: Apr. 29, 2010

(65) Prior Publication Data

US 2010/0213343 A1 Aug. 26, 2010

Related U.S. Application Data

(63) Continuation of application No. 12/221,986, filed on Aug. 8, 2011, now abandoned, which is a continuation of application No. 10/566,137, filed as application No. PCT/AU03/00952 on Jul. 30, 2003, now abandoned.

(51) Int. Cl.
*A47B 97/04* (2006.01)

(52) U.S. Cl. ..... 248/441.1; 248/450

(58) Field of Classification Search ..... 248/441.1, 248/444, 445, 450, 551; 5/636, 645; 462/71; 281/45

See application file for complete search history.

(56) References Cited

U.S. PATENT DOCUMENTS

| | | | | |
|---|---|---|---|---|
| 1,928,806 | A * | 10/1933 | Barcalo | 5/639 |
| 1,934,254 | A * | 11/1933 | Barcalo | 5/639 |
| 3,400,413 | A * | 9/1968 | La Grossa | 5/639 |
| 4,011,611 | A | 3/1977 | Lederman | 5/361 B |
| 4,109,960 | A | 8/1978 | Stinchfield | 297/258 |
| 4,967,992 | A | 11/1990 | Menaged | 248/454 |
| 4,978,096 | A | 12/1990 | Struckmann | 248/451 |
| 5,941,599 | A | 8/1999 | Roberts | 297/115 |
| 6,044,758 | A | 4/2000 | Drake | 100/43 |
| 6,073,288 | A | 6/2000 | Berenstein | 5/636 |
| 6,270,050 | B1 * | 8/2001 | Friedrich | 248/444 |
| 6,434,770 | B2 | 8/2002 | Matthews Brown | 5/636 |
| 6,820,850 | B2 * | 11/2004 | Coleman | 248/346.07 |
| 6,820,852 | B2 | 11/2004 | Wainscott et al. | 248/444.1 |
| 2002/0184709 | A1 | 12/2002 | Berry, IV | 5/655.4 |

FOREIGN PATENT DOCUMENTS

| | | |
|---|---|---|
| FR | 2 424 004 A1 | 11/1979 |
| GB | 2 059 758 A | 4/1981 |

* cited by examiner

*Primary Examiner* — Ramon Ramirez
(74) *Attorney, Agent, or Firm* — Seed IP Law Group PLLC

(57) ABSTRACT

A book rest is provided including a bag filled with a particle matter and having inserts for supporting a book in a reading position. The book rest includes an insert on which a bottom of the book can rest and other inserts on which the front and back of the book may lean against. The book rest may also be provided with a page holder, held in position by a toggle which is threaded onto elastic for attaching the page holder to the book rest. The page holder can slide up the elastic, pressing the book holder firmly against the book. Sections of the book holder can slide under the edges of the book, thus ensuring that the book holder presses firmly against the book's pages and keeps the book open in a hands free reading position.

17 Claims, 3 Drawing Sheets

BOOK REST WITH PAGE HOLDER

CROSS-REFERENCE TO RELATED APPLICATION

This application is a continuation of U.S. patent application Ser. No. 12/221,986, filed Aug. 8, 2011, now abandoned, which is a continuation of U.S. patent application Ser. No. 10/566,137, filed on Feb. 5, 2007, now abandoned, which is a U.S. National Phase Application under 35 U.S.C. §371 of International Application No. PCT/AU2003/000952, filed on Jul. 30, 2003, where these applications are incorporated herein by reference in their entireties.

BACKGROUND

1. Technical Field

This disclosure is related to book rests.

2. Description of the Related Art

Books are typically held in a reader's hands when reading; however, a reader's hands or arms may become fatigued when reading in this manner for extended periods of time.

BRIEF SUMMARY

According to one embodiment, a book rest may be summarized as including a bean filled bag with inserts for supporting a book. The inserts may include a plurality of flat sections, including a flat section on which the bottom of the book may sit and two other flat sections on which the front and back of the book may rest. The bag may be made of a flexible and pliable material, such as, for example, PVC, vinyl or cloth (including woven fabric). The book rest may further include an adjustable page holder that holds the book open so as to enable a user hands free reading. The adjustable page holder may be made of wood, fiber glass, carbon fiber or plastic materials, such as, for example, Perspex™. The page holder may be held in position by a toggle threaded onto elastic which enables the page holder to slide up the elastic to press firmly against the book. Sections or portions of the page holder may slide under the edges of the book, thus ensuring the page holder presses firmly against the pages of the book to keep the book open.

BRIEF DESCRIPTION OF THE SEVERAL VIEWS OF THE DRAWINGS

The invention may be better understood with reference to the illustrations of embodiments of the invention in which.

DETAILED DESCRIPTION

Figure 1:
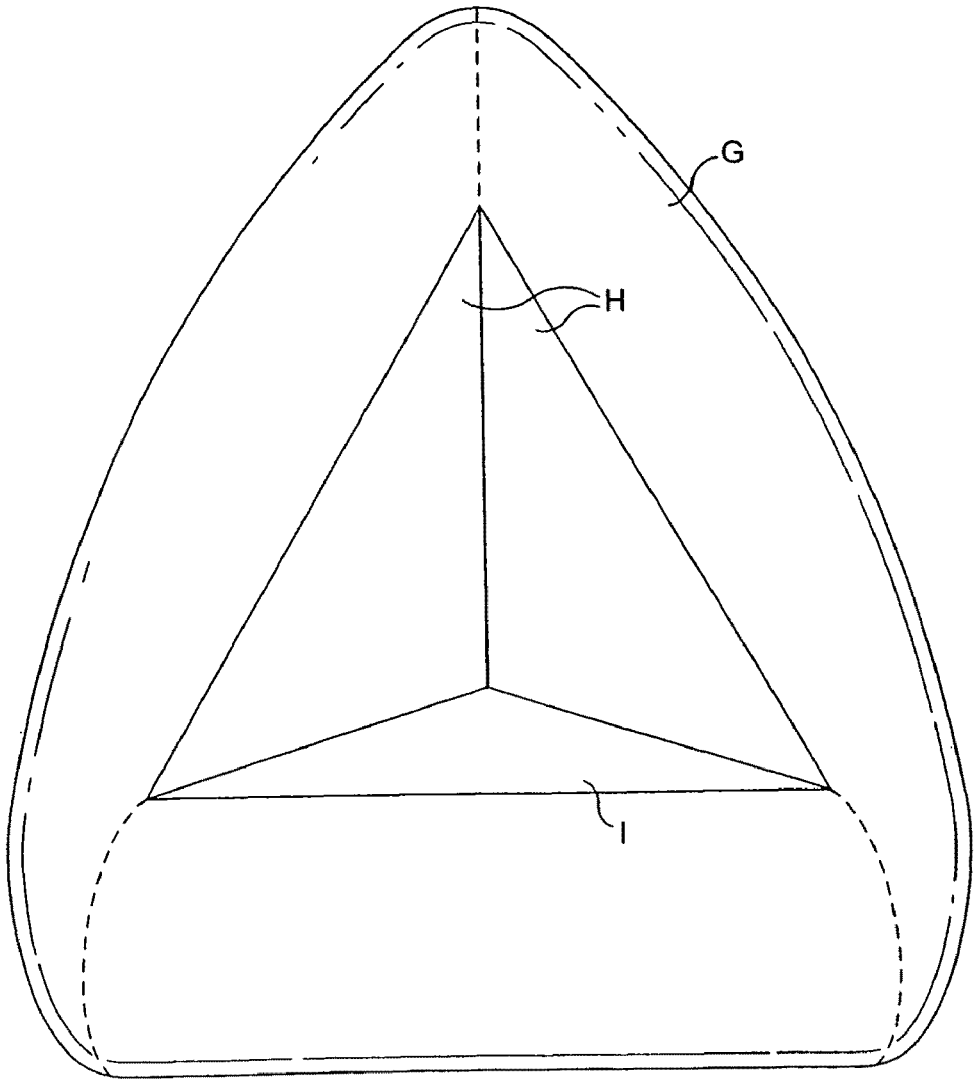
FIG. 1 is a front perspective view of a book rest, according to one embodiment, having inserts of flat sections on which a book may be supported.

The book rest which is shown in FIG. 1 includes a bag (G) made of a flexible and pliable material, such as, for example, PVC, vinyl or cloth (including woven fabric). The bag (G) contains a suitable particle matter such as foam beads, balls or beans, which enable the flexibility needed to adjust the position of the book rest and sit the book rest comfortably on any surface. The bottom of a reader's book may then sit on a stiff insert (I) of the book rest in an open position, as shown in FIG. 3, while the front and back of the book lean on other stiff inserts (H). The inserts (I), (H) may be flat sections that combine to define an alcove for the book, as shown in FIGS. 1 through 3.

Figure 2:
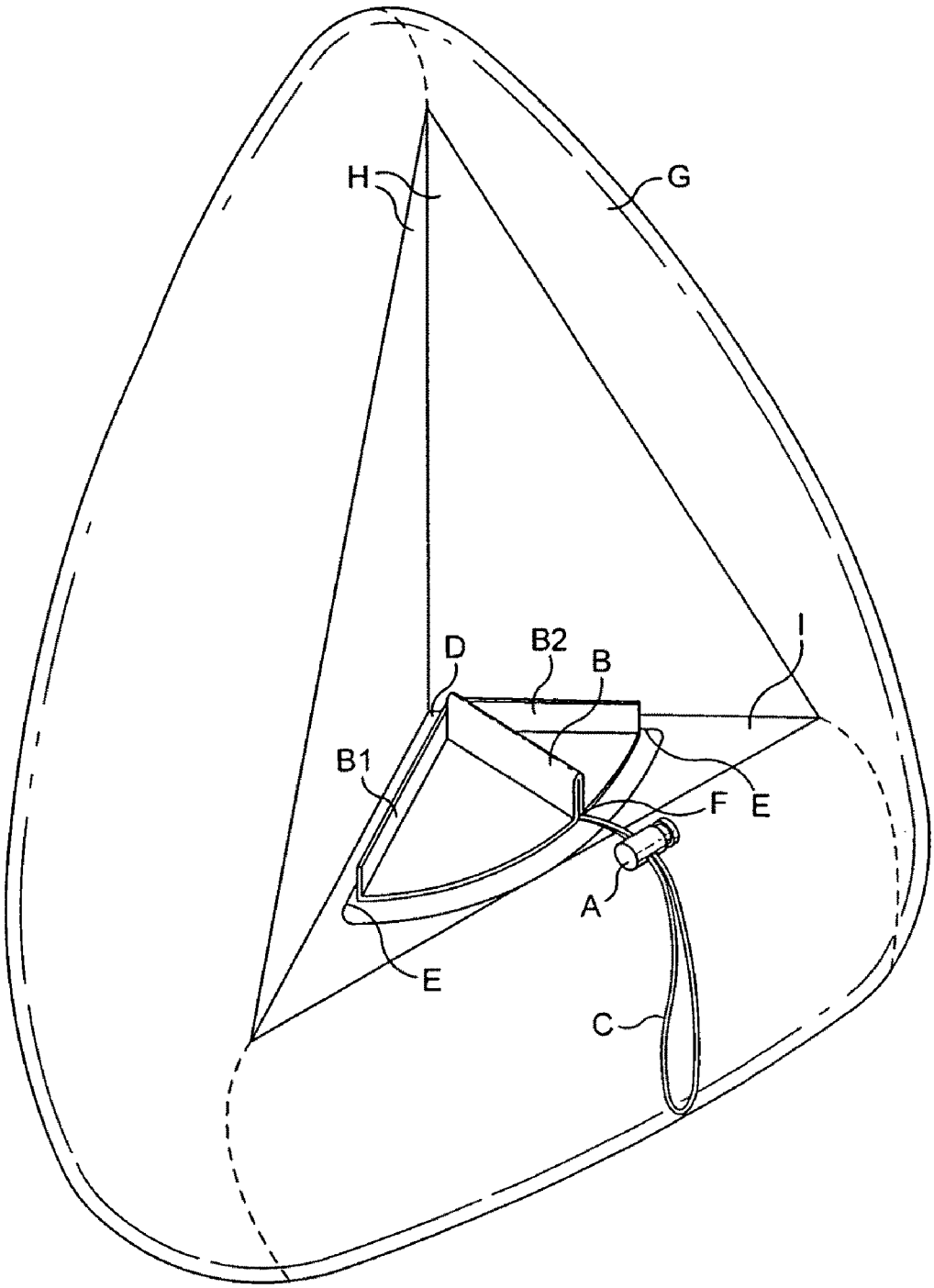
FIG. 2 is another perspective view of the book rest of FIG. 1 with a page holder in place on the book rest.
Figure 3:
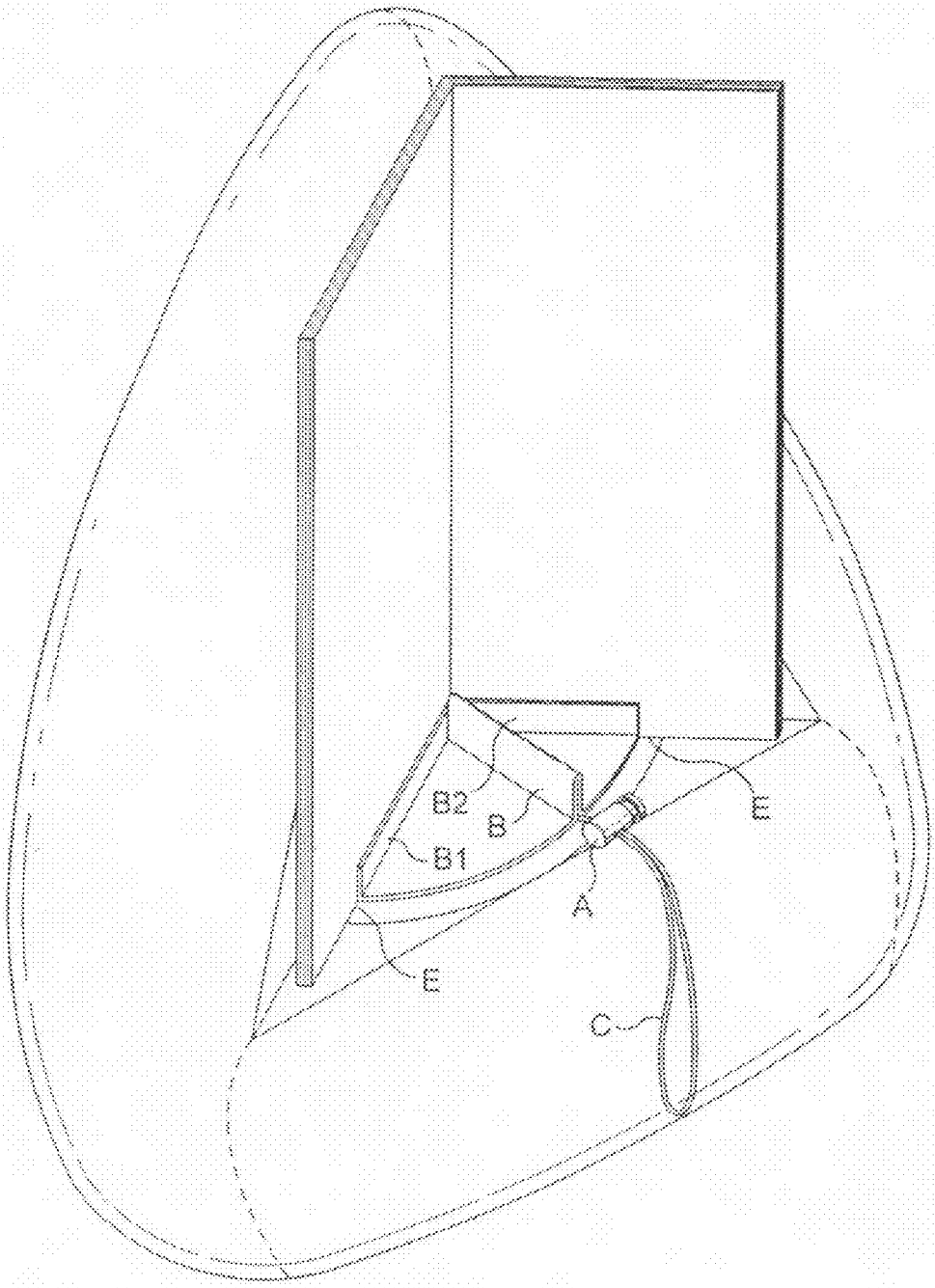
FIG. 3 is another perspective view of the book rest of FIG. 1 with a page holder holding a book in an open position.

FIG. 2 shows a page holder (B) received on the stiff insert (I) of the book rest. The page holder (B) may be made of plastic, such as a stiff Perspex™ material, or a plastic like material. The adjustable page holder may also be made of wood, fiber glass or carbon fiber.

As shown in FIG. 2, elastic (C) can be threaded through hole (F) in said page holder (B) and attached to the book rest at point (D). A toggle (A) can move along the elastic (C) for easy adjustment of the page holder (B). Page holder edges (E) can slide under each side of the book to keep it in place, as shown in FIG. 3.

FIG. 3 shows a book in an open position, resting on the book rest. To ensure that the pages don't move, and that the reader can indeed read hands free, the page holder edges (E), can slide under the edges of the book to allow parts (B1) and (B2) of the page holder (B) to press firmly against the pages of the book. The toggle (A) enables a reader to slide up the toggle (A) and tension the elastic (C), to pull and hold the page holder (B) in position against the book. The page holder (B) can also be slid towards the reader and away from the book, whilst still under some tension from the elastic (C).

In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A book rest comprising:

a bag filled with particle matter; and inserts of flat sections attached to the bag, the inserts defining an alcove to hold a book in a hands free reading position and including a first section on which a bottom of the book sits when the book is supported by the book rest and other sections on which a front and a back of the book rest when the book is supported by the book rest.

2. The book rest of claim 1, further comprising:

an adjustable page holder configured to hold the book open when the book is supported by the book rest so as to enable a user hands free reading.

3. The book rest of claim 2 wherein the page holder is made of perspex.

4. The book rest of claim 2 wherein the page holder is made of plastic.

5. The book rest of claim 2 wherein the page holder is made of wood.

6. The book rest of claim 2 wherein the page holder is made of fiber glass.

7. The book rest of claim 2 wherein the page holder is made of carbon fiber compound.

8. The book rest of claim 1 wherein the bag is made of PVC.

9. The book rest of claim 1 wherein the bag is made of a woven fabric.

10. The book rest of claim 1 wherein the bag is made of vinyl.

11. The book rest of claim 1 wherein the bag is made of a cloth material.

12. The book rest of claim 1 wherein the particle matter in the bag is at least one of foam beads, balls and beans.

13. The book rest of claim 1 wherein the inserts of flat sections define an alcove for receiving the book in a generally upright position.

14. The book rest of claim 13, further comprising:

a page holder configured to press the book open against the alcove when the book is supported by the book rest so as to enable a user hands free reading.

15. The book rest of claim 14 wherein portions of the page holder are positioned to slide under the book to keep the book in position.

16. The book rest of claim 14, further comprising:

elastic coupling the page holder to the bag; and a toggle coupled to the elastic for selectively adjusting an amount of force that the page holder applies to the book when the book is supported by the book rest.

17. The book rest of claim 14 wherein a force applied to the book by the page holder is adjustable.

* * * * *

UNITED STATES PATENT AND TRADEMARK OFFICE

CERTIFICATE OF CORRECTION

PATENT NO. : 8,083,200 B2
APPLICATION NO. : 12/799738
DATED : December 27, 2011
INVENTOR(S) : Cindy Jane Opresnik It is certified that error appears in the above-identified patent and that said Letters Patent is hereby corrected as shown below:

On the Title page, Item (63):
"Continuation of application No. 12/221,986, filed on August 8, 2011, now abandoned, which is a continuation of application No. 10/566,137, filed as application No. PCT/AU03/00952 on July 30, 2003, now abandoned." should read, --Continuation of application No. 12/221,986, filed on August 8, 2008, now abandoned, which is a continuation of application No. 10/566,137, filed as application No. PCT/AU03/00952 on July 30, 2003, now abandoned.--.

Signed and Sealed this
Twenty-sixth Day of June, 2012

David J. Kappos

David J. Kappos
*Director of the United States Patent and Trademark Office*